United States Patent [19]

Yecheskel et al.

[11] Patent Number: 4,796,334

[45] Date of Patent: Jan. 10, 1989

[54] TREATMENT OF COTTON

[76] Inventors: Herzel B. Yecheskel, 1 Eliahu Hanassi Street, Bat Yam; Gad Alon, 14 Hazaz Street, Herzlia; Eliezer Beck, 40 Wolfson Street, Rishon Lezion, all of Israel

[21] Appl. No.: 833,987

[22] Filed: Feb. 26, 1986

[30] Foreign Application Priority Data

Feb. 27, 1985 [IL] Israel ..... 74469

[51] Int. Cl.[4] ..... D01G 37/00; D01G 7/06

[52] U.S. Cl. ..... 19/0.27; 19/80 R

[58] Field of Search ..... 19/0.27, 80 R, 81

[56] References Cited

U.S. PATENT DOCUMENTS 4,535,510 8/1985 Shoham ..... 19/0.27

*Primary Examiner*—Louis K. Rimrodt

*Attorney, Agent, or Firm*—Michael J. Striker

[57] ABSTRACT

The invention relates to a process for rendering harmless sticky material adhering to cotton fibers, termed "honeydew". According to the process the cotton is heated for a brief period of time to a temperature adequate to render said honeydew hard and brittle, and this without adversely affecting the cotton fibers. There are also provided means for effecting such treatment of cotton fibers in a continuous manner.

1 Claim, 6 Drawing Sheets

TREATMENT OF COTTON

FIELD OF THE INVENTION

There are provided means for overcoming the problems caused by the presence of honeydew on cotton fibers when these are being continually processed. Such honeydew is rendered hard and brittle, substantially reducing or obviating its adhesive properties. This is done without adversely affecting the properties of the cotton fibers and without causing any discoloration of these. Simple devices are provided for carrying out such process.

BACKGROUND OF THE INVENTION

Sticky contaminants, resulting from a variety of insects, and especially from the white fly (Bamessia), for instance, are frequently present on cotton when this is picked. Such contaminants, generally referred to as "honeydew" renders the cotton sticky, and this causes severe problems, especially during the drawing of the slivers: as these pass through the conventional pairs of rollers, the honeydew causes adhesion to these rollers, further fibers become attached and the end-result is a work stoppage and the necessity to clean the rollers. This results in a lack of uniformity of the slivers and yarns which are produced, in serious time losses and increase of production costs with a reduction of quality of the product.

Although the quantity of such honeydew quantified by the content of reducing sugars contained therein, is generally quite low (of the order of 0.1 to 1.5 per cent by weight), it causes serious problems during the various steps of the processing of cotton, and especially in the spinning process. The present invention overcomes to a large extent the problems caused by such adhesive substances and renders them harmless.

The contamination of the cotton with honeydew or the like causes problems in the processing of the cotton, at its various stages.

It is clear that the process of the invention is applicable at any of the stages of the processing of the cotton, and an early stage is of course advantageous.

Serious problems are generally encountered with such contaminated cotton during the processing on the draw frame. In the spinning process of cotton, a web is formed on a carding machine. Separation of fiber tufts into individual fibers and forming the web are done on a revolving flat card, which is a particular type of carding machine. After leaving the card, the web is pulled through a funnel-shaped hole and thus there is formed a so-called card sliver. To produce a yarn, the sliver has to be attenuated, possibly combed and finally twisted. Six to eight slivers are fed to a draw frame, and these are drawn into one, and this operation is accompanied by attenuation or drafting.

SUMMARY OF THE INVENTION

There is provided a process for rendering harmless sticky constituents of raw cotton, such as honeydew droplets adhering to cotton fibers, and which are produced by insects such as the White Fly (*Bamessia tabacci*).

Honeydew droplets as well as droplets of other adhesive or sticky substances which consist to a large part of sugars and/or polysaccharides, cause serious problems during the various processing steps of cotton.

It is known that during laboratory tests when cotton containing honeydew is heated in a stationary manner during about 2 hours at 130° C., such cotton becomes colored yellow to yellowish-brown, as this becomes discolored by caramelized honeydew.

It has now been discovered that by subjecting cotton to a controlled heating process with a maximum of about 140° C. during a controlled period of time with a maximum of 10 seconds, and advantageously up to about 5 seconds with cotton slivers, such droplets can be rendered brittle and hard losing their adhesive properties without adversely affecting the cotton quality. The heating may be effected at any step of the process, but preferably before the drawing of the cotton slivers on the draw frame, as at this stage the most serious problems occur.

A further step of the process is to separate the brittle drops from the cotton fibers.

There are provided simple devices,e.g. comprising a number of rotatory rollers, the surface temperature of which is maintained at a predetermined value, means being provided for passing the cotton sliver over such heated rollers so as to maintain contact for an adequate period of time to convert the sticky material to hard and brittle particles.

The heating process can be effected at any stage of the processing of cotton fibers. It has been found that when the cotton is heated so as to reach a temperature of about 70° to 140° C., and maintained at such temperature for an adequate period of time, adhering honeydew droplets are converted to hard and brittle particles. The overall heating time of the cotton is about ½ to about 5 seconds for slivers and up to 10 seconds for cotton bales (upper surface), and such heating substantially reduces the stickiness of the fibers or eliminates it altogether.

BRIEF DESCRIPTION OF THE DRAWINGS

In the enclosed schematical drawings, which are not according to scale:

As shown in FIG. 1, cotton slivers 11 are drawn from the six cans 12 and over flat surface 13 under roller 14, and through the rotatory rollers 15 and 16, and from these to the conventional draw frame 17 which comprises 4 roller pairs 18, 19, 20 and 22, from which the resulting sliver 23 is drawn into the container 24.

The rollers 15 and 16 are provided with internal electrical heating means which are provided with heat control means, so that the surface temperature of the rollers 15 and 16 can be adjusted to any predetermined value. Various experiments have shown that generally surface temperatures of from about 150° C. and to about 230° C. are satisfactory. The cotton slivers 12 are pressed over the said rollers 15 and 16 at a speed of about 30 m/min (or 50 cm/sec). The slivers tested were 4 g/m sticky cotton, contaminated with considerable quantities of honeydew. The contact length of the slivers with the rollers was a total of about 55 cm and the cotton was heated during this period of time in such manner that it reached a temperature of about 75° C. The heating to this temperature for the contact time indicated, was adequate to render the adhesive droplets hard and brittle. When the conventional device was used without this attachment, the cotton slivers stuck to the roller pairs and caused serious problems.

When the rollers are heated to a higher temperature, the time of contact can be decreased.

Figure 3:
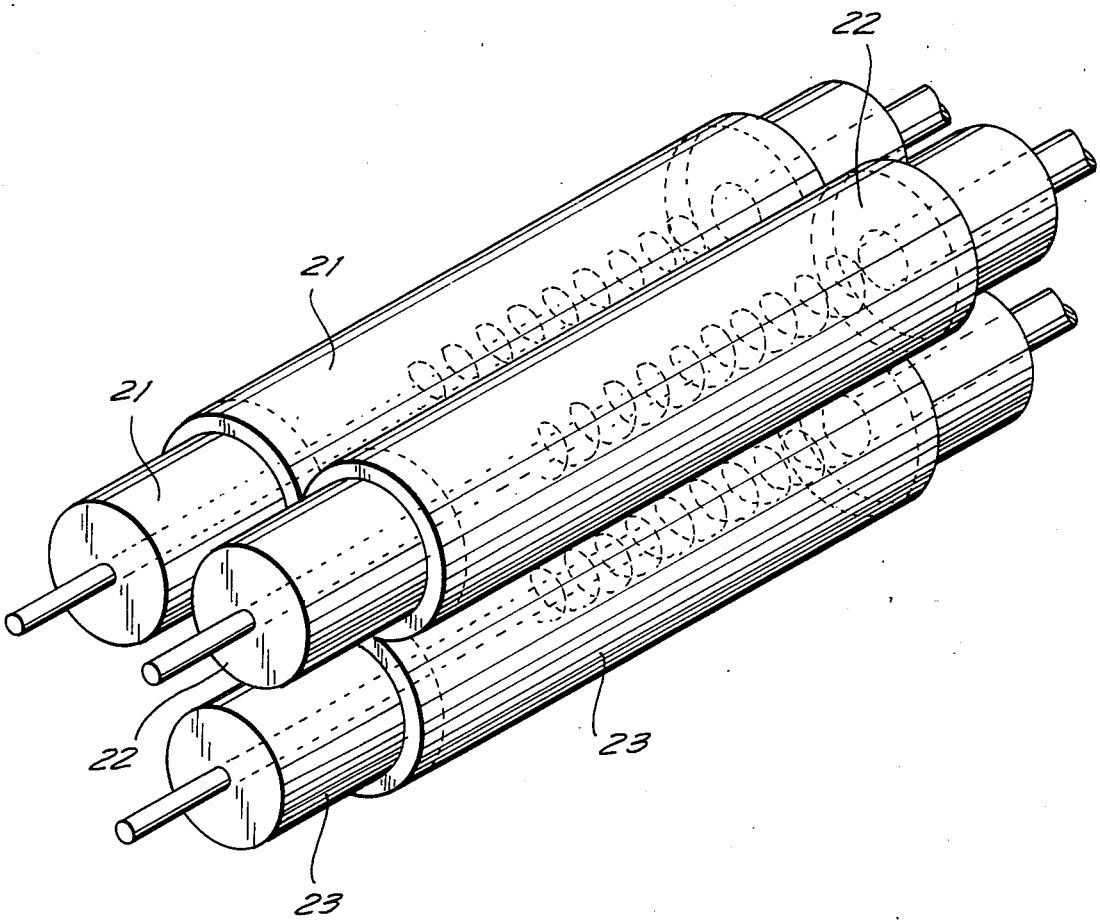
FIG. 3 is a perspective view of 3 rollers, with details of the heating means.

Details of a three-roller system is shown in FIG. 3. The rollers 21, 22 and 23 are provided with internal electrical heating coils and with electrical leads for connection with a power source. Heating of the electrical resistance elements results in a predetermined surface temperature of the rollers, which may be automatically maintained within a narrow range by means of a thermostat.

Figure 1:
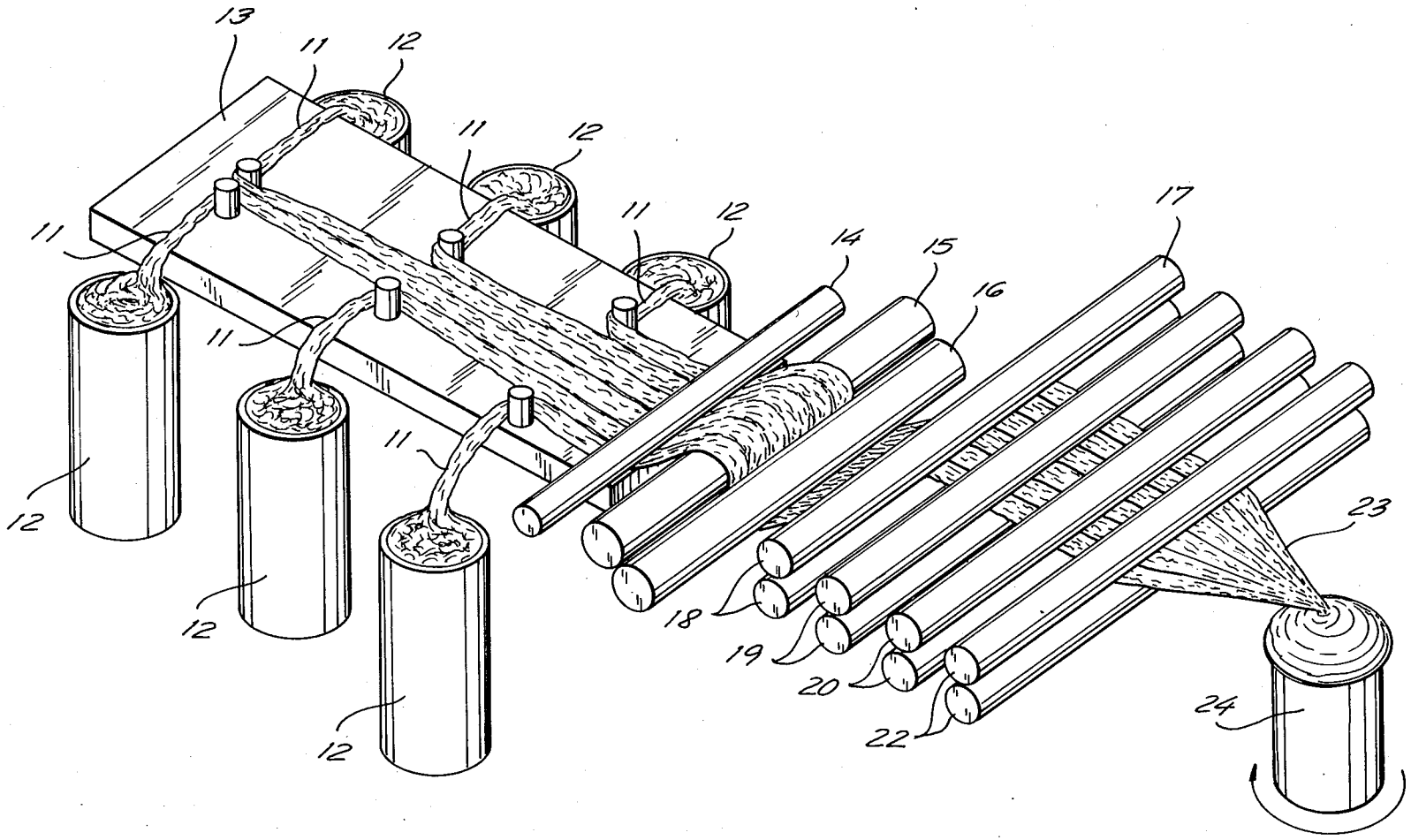
FIG. 1 is a perspective view of a device of the invention in combination with a conventional drawing frame.
Figure 2:
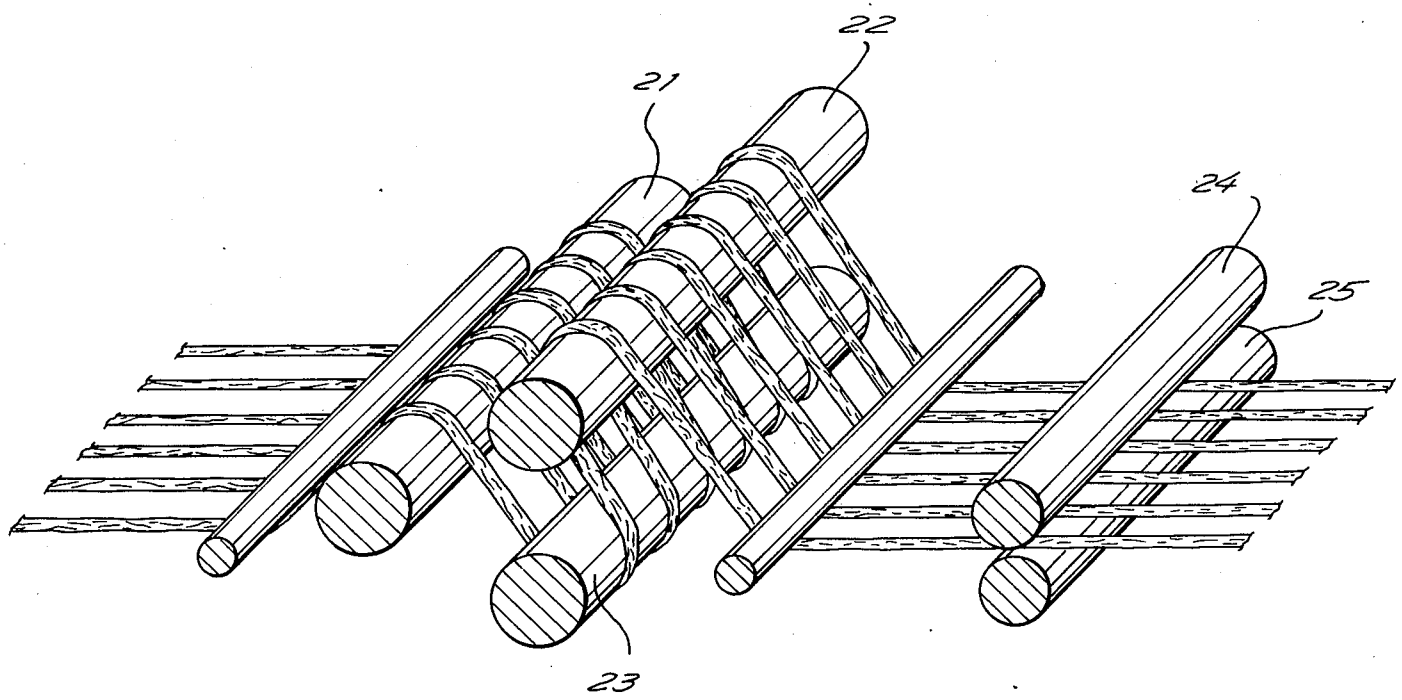
FIG. 2 is a perspective side-view of part of such device with three heated rollers.
Figure 4:
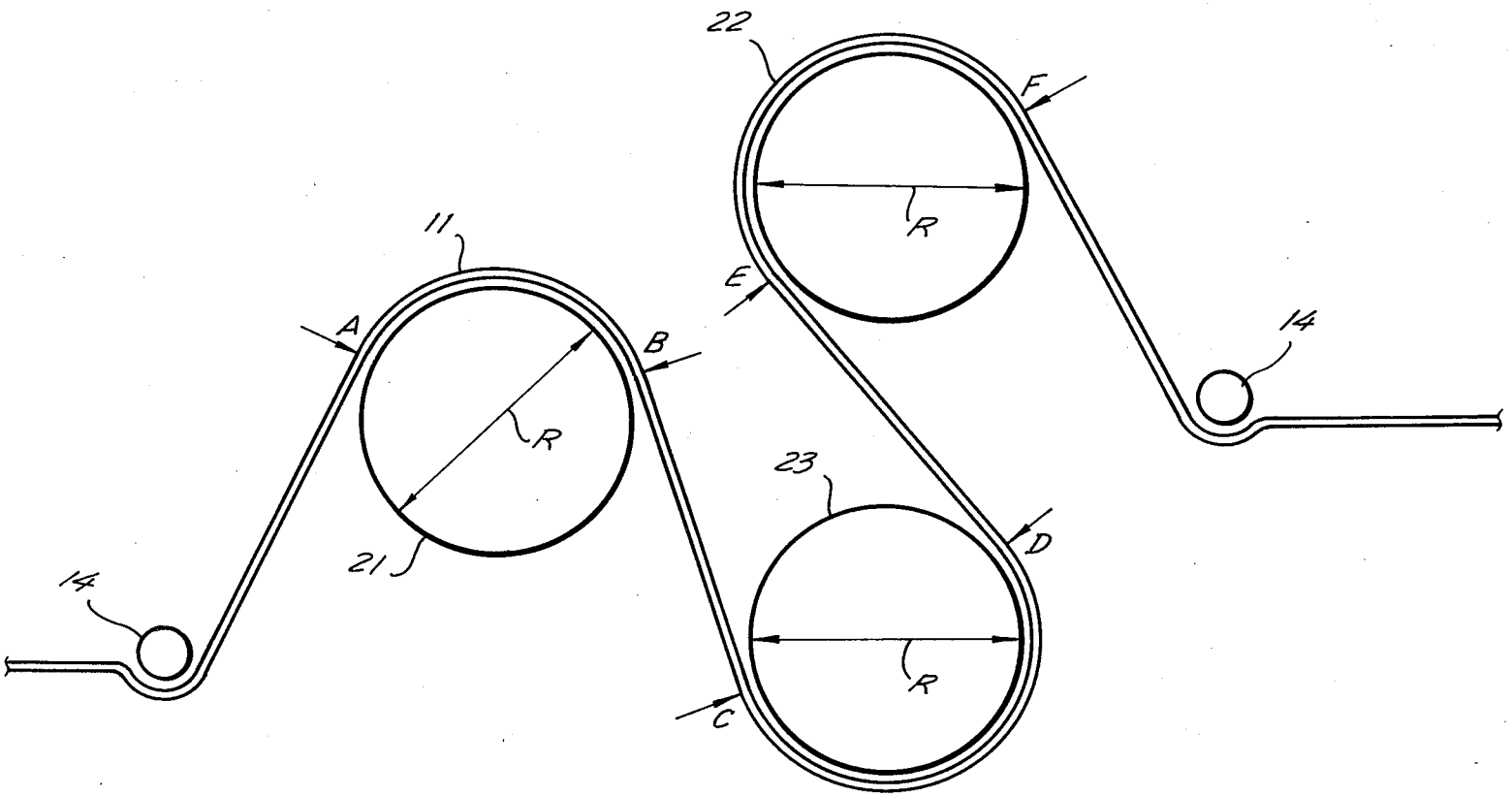
FIG. 4 illustrates a roller system of a device of the invention.

FIG. 2 illustrates a device provided with three electrically heated rollers 21, 22 and 23, from which the slivers move to the draw frame, the first pair of rollers of which, 24 and 25, are shown. The dimensions of the rollers 21, 22 and 23, and the configuration of these are shown in detail in FIG. 4. The rollers have each a diameter of 85 mm and the distance between the surfaces of these rollers is 30 mm. The total length of contact from the points A to B, plus C to D,, plus E to F, of the cotton sliver moving in the direction of M, with the three rollers of the device of the invention, is about 55 cm. Heating of the cotton sliver to a minimum temperature of 70° C. at a velocity of 30 m/sec renders the adhering honeydew droplets brittle and hard. When the sliver is moved at a higher velocity there must be used a higher surface temperature and/or a longer path of contact with the heated surfaces. The further processing of the slivers does not cause any problems. The hard droplets are subsequently crushed to powder or to small particles, and can be sucked off. No adverse effect was observed as regards cotton quality or color. It is generally advisable to allow the cotton to attain equilibrium with ambient humidity before further processing.

It is clear that the rollers may be heated with hot air, hot liquid and that any combination of heat conduction, convection and radiation may be used in the heating process.

Figure 5:
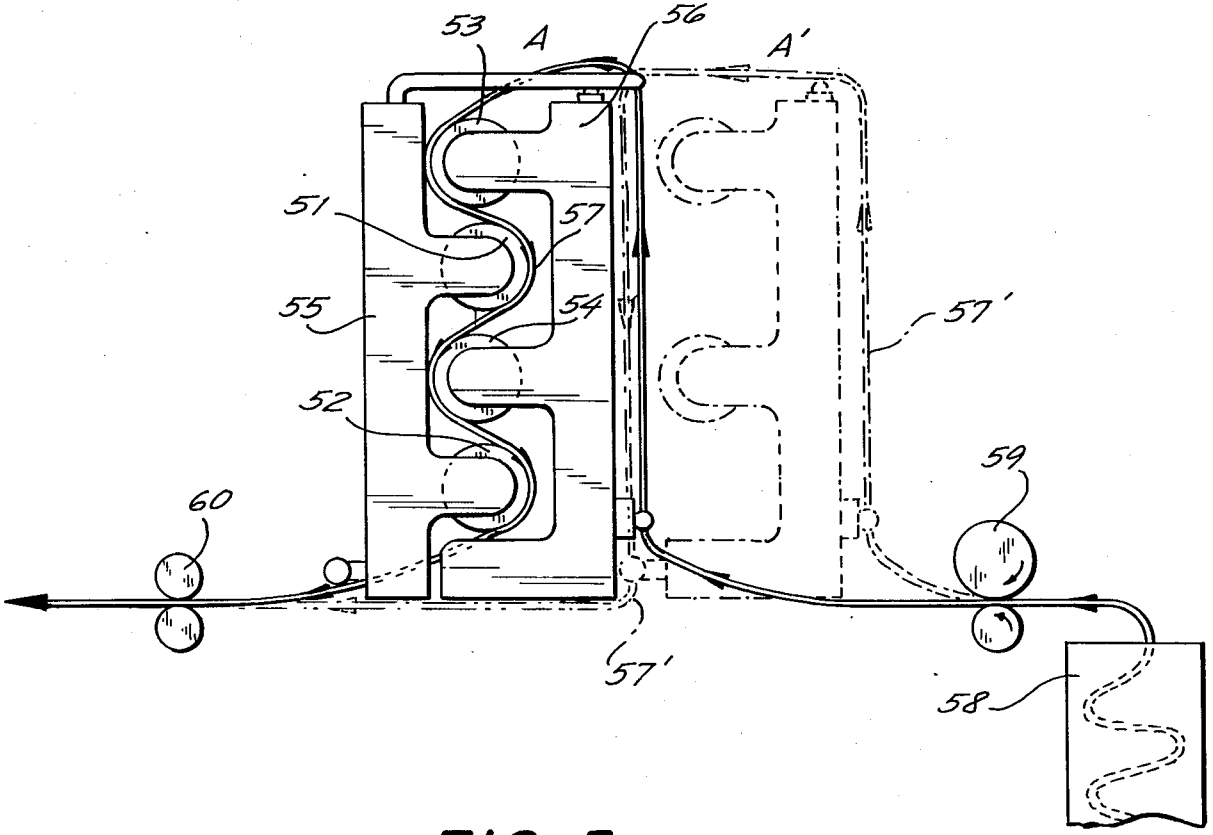
FIG. 5 is an elevational sectional view through a further embodiment of a heating system according to the invention.

As shown in FIG. 5, there is provided a system comprising four heated rollers 51, 52, 53 and 54, each of which is provided with a heating element (not shown) which maintains during operation a predetermined and preselected surface temperature.

As shown, the system comprises a support frame 55 on which there are mounted the heated rollers 51 and 52, whereas the rollers 51 and 54 are mounted on movable frame 56.

When frame 56 is in the A position, the cotton sliver 57, from container 58, passes essentially in contact with half the circumference of each of the rollers 51 to 54, as shown in the figure, and through roller pairs 59 and 60, which are synchronized with the other rollers. In this position, the cotton sliver 57 takes the configuration shown by the full line. When for any reason the process is to be interrupted, in order to prevent overheating, frame 56 is moved towards the right, reaching the position indicated in dashed lines, A', with the cotton sliver in the dashed configuration in which this sliver is out of contact with any heated surface. This movement can automatically be actuated whenever the process is to be temporarily interrupted. When treatment of the cotton sliver is to be resumed, the device is actuated, the right-hand-side rollers move again to the position adjacent to the left-hand ones, which takes a few seconds. Only after the rollers have again reached the original position, is the movement of the slivers actuated. It is of course possible to use any number of heated rollers, from 3 upwards, with at least one being on the right-hand side frame.

Figure 6:
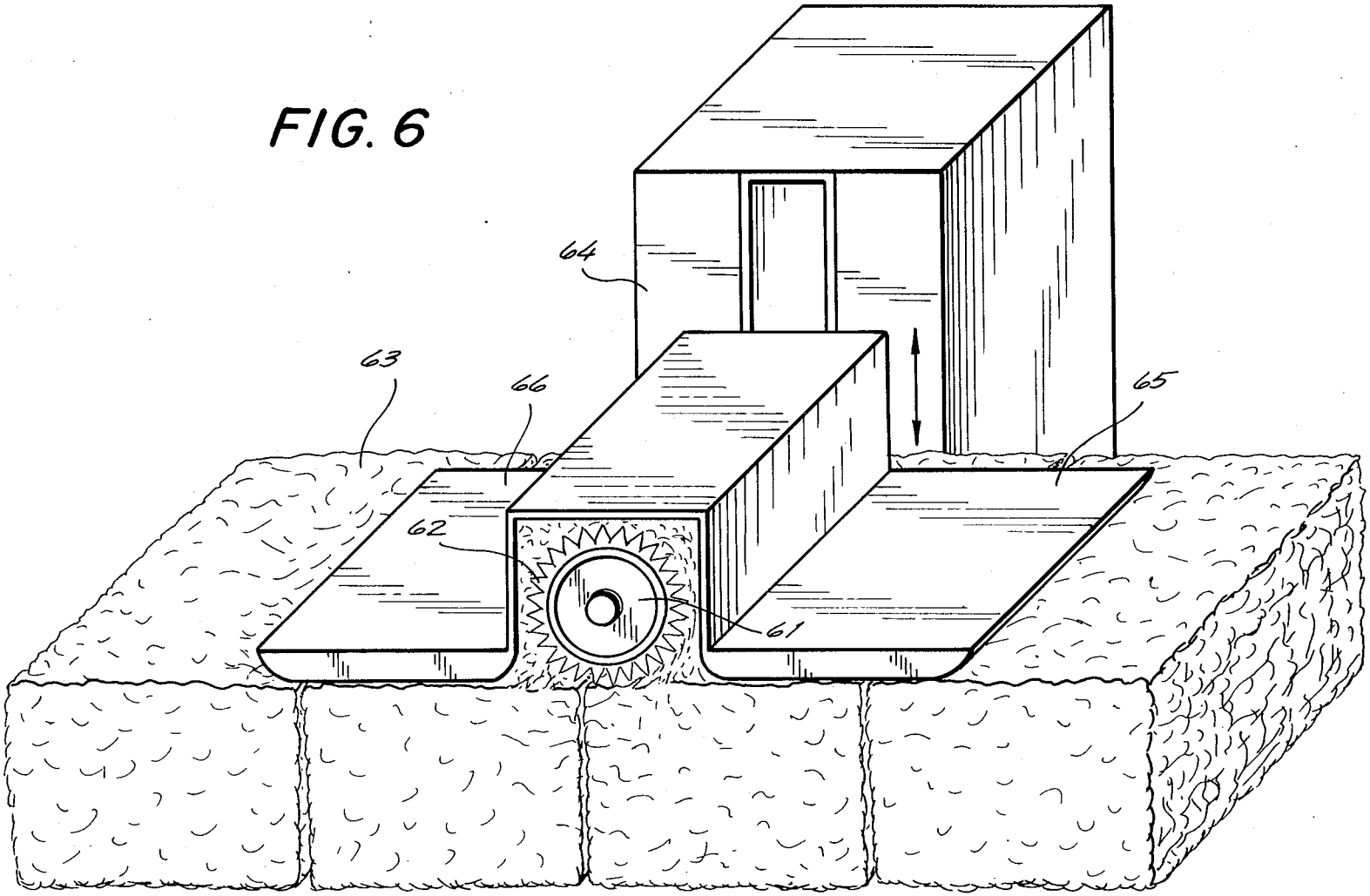
FIG. 6 is a perspective side-view of another embodiment of a device for the heat treatment of cotton to render honeydew droplets non-adhesive.

The surface temperature does not differ from that set out in the other embodiments, and also the period of time during which the cotton sliver is in touch with the heated rollers. A further embodiment of the invention is illustrated with reference to FIG. 6. Raw cotton is supplied in the form of bales 63, and flock or tufts 62, detaching machines are used in order to gradually remove the cotton in the form of tufts which are removed by a moving device. The tufts are removed by means of a wheel 61 in a plurality of passes over the bales 63 which are arranged in line, and thus there is also obtained a homogenous blend of a plurality of bales, resulting in a uniform product. The thickness of the cotton layer which is removed in each pass can be preselected within a rather wide range. The tufts are sucked by a vacuum system (not shown) into a further stage of processing.

The wheel 61 is provided with a plurality of teeth or other structures for plucking the tufts 62 and which rotate so as to remove the tufts of cotton as the device passes over the bales of cotton 63, the tufts being sucked by means of the vacuum system into section 64. According to the invention there are provided heating devices 65 and 66, with heating means adapted to maintain the surface of the plates in contact with the cotton at a predetermined and preselected temperature as the device moves over said bales. When the device moves from left to right, the heating device 65 is heated, when the movement is in the opposite direction, heating devise heated. The contact of the heated plates with the upper layer of the cotton is such that it renders the honeydew particles (droplets) brittle and hard. Such attachment may be used in addition to said heated-roller devices of the invention, or it may be used, to a large extent, instead of the roller devices.

According to a preferred embodiment, both plates 65 and 66 are heated.

It is clear that the process of the invention can be effected before the blending of the slivers to a single sliver on the draw frame. The process can also be effected at any preceding stage of the processing of the cotton.

It is clear that the heating, after ginning, at the gin or at the spinning mill, to a temperature of above 70° C. can be effected by various means such as hot air, IR heating or the like, as set out above. The invention is intended to encompass any steps adequate to heat-treat cotton fibers before or during processing at the spinning mill. This treatment results in a rendering of the adhesive sticky honeydew droplets to a hard and brittle form. The devices for heating the upper surfaces of cotton bales can also be provided as separate entities, to be used in conjunction with flock-detaching machines. The hard and brittle droplets are generally crushed to small particles or powder as the slivers pass through the draw frames, or they can be passed through a pair of crushing rollers. Such particles and powder is advantageously removed by a vacuum suction system.

It is clear that various changes and modifications of devices suitable for such heating can be resorted to without departing from the scope and spirit of the present invention.

We claim:

1. A device for rendering adhesive honeydew droplets adhering to cotton fibers non-adhesive, and for rendering them brittle and hard, which comprises at least one heated means with which the cotton fibers are brought into contact so that the fibers are heated to a temperature higher than 70° C., for a period of time of from ½ to about 3 seconds, the heated means being formed as a heated plate which is contacted with the upper surface of cotton bales as cotton tufts are plucked from them by a bale opener, said contact preceding the removal of cotton tufts by the bale opener, the surface temperature of the heated plate being adequate to render honeydew droplets or other sticky substances, non-sticky.

* * * * *